US005988787A

United States Patent [19]

Watanabe et al.

[11] Patent Number: 5,988,787

[45] Date of Patent: Nov. 23, 1999

[54] INK JET APPARATUS HAVING A RECORDING UNIT CARTRIDGE INCLUDING A RECORDING HEAD, INK SUPPLY SYSTEM AND INK COLLECTING MEMBER

[75] Inventors: Fumihiko Watanabe; Takeshi Ono, both of Yokohama; Akio Okubo, Tokyo; Atsushi Saito, Yokohama; Yasuhiko Ikeda, Sagamihara, all of Japan

[73] Assignee: Canon Kabushiki Kaisha, Tokyo, Japan

[21] Appl. No.: 08/478,828

[22] Filed: Jun. 7, 1995

Related U.S. Application Data

[63] Continuation of application No. 08/281,662, Jul. 28, 1994, abandoned, which is a continuation of application No. 07/973,549, Nov. 9, 1992, abandoned, which is a continuation of application No. 07/633,956, Dec. 26, 1990, abandoned.

[30] Foreign Application Priority Data

| | | | |
|---|---|---|---|
| Dec. 26, 1989 | [JP] | Japan | 1-339205 |
| Dec. 26, 1989 | [JP] | Japan | 1-339206 |
| Dec. 26, 1989 | [JP] | Japan | 1-339207 |
| Dec. 14, 1990 | [JP] | Japan | 2-402158 |

[51] Int. Cl.[6] ..... B41J 2/165; B41J 2/14; B41J 2/175

[52] U.S. Cl. ..... 347/22; 347/29; 347/49; 347/85

[58] Field of Search ..... 347/22, 29, 30, 347/23, 32, 33, 108, 104, 102, 3, 49, 85; 399/110, 122, 124, 125; 219/216

[56] References Cited

U.S. PATENT DOCUMENTS

| | | | |
|---|---|---|---|
| 3,839,721 | 10/1974 | Chen et al. | 346/75 |
| 4,176,363 | 11/1979 | Kasahara | 347/23 |
| 4,313,124 | 1/1982 | Hara | 347/57 |
| 4,345,262 | 8/1982 | Shirato et al. | 347/10 |
| 4,371,881 | 2/1983 | Bork et al. . | |
| 4,437,105 | 3/1984 | Mrazek et al. . | |
| 4,459,600 | 7/1984 | Sato et al. | 347/47 |
| 4,463,359 | 7/1984 | Ayata et al. | 347/56 |
| 4,467,348 | 8/1984 | Fujii et al. | 347/3 |
| 4,469,026 | 9/1984 | Irwin | 347/102 |
| 4,531,823 | 7/1985 | Degushi et al. | 399/124 |
| 4,558,333 | 12/1985 | Sugitani et al. | 347/65 |
| 4,577,203 | 3/1986 | Kawamura | 347/30 |
| 4,630,921 | 12/1986 | Watanabe | 355/35 H |
| 4,695,855 | 9/1987 | Ichihashi et al. | 346/145 |

(List continued on next page.)

FOREIGN PATENT DOCUMENTS

| | | | |
|---|---|---|---|
| 0323261 | 7/1989 | European Pat. Off. . | |
| 0335699 | 10/1989 | European Pat. Off. . | |
| 54-56847 | 5/1979 | Japan . | |
| 107735 | 8/1979 | Japan | 347/102 |
| 0074890 | 6/1980 | Japan | 400/126 |
| 58-7362 | 1/1983 | Japan . | |
| 188685 | 11/1983 | Japan | 347/102 |
| 59-123670 | 7/1984 | Japan . | |
| 59-138461 | 8/1984 | Japan . | |
| 60-71260 | 4/1985 | Japan . | |
| 145071 | 6/1988 | Japan | 347/108 |
| 2087800 | 6/1982 | United Kingdom . | |

*Primary Examiner*—N. Le
*Assistant Examiner*—Craig A. Hallacher
*Attorney, Agent, or Firm*—Fitzpatrick, Cella, Harper & Scinto

[57] ABSTRACT

A recording unit cartridge includes as a unit: a recording head for ejecting ink to effect recording; an ink supply system for supplying the ink to the recording head; a capping member for covering an ink ejection side surface of the recording head; an ink collecting member for the ink discharged to recover the recording head and not used for recording; a cleaning member for cleaning the ink ejection side surface of the recording head; and a casing for containing as a unit the head system and members, wherein the unit cartridge is detachably mountable to a main assembly of a recording apparatus.

8 Claims, 8 Drawing Sheets

U.S. PATENT DOCUMENTS

| | | | |
|---|---|---|---|
| 4,698,650 | 10/1987 | Watanabe et al. | 346/134 |
| 4,723,129 | 2/1988 | Endo et al. | 347/56 |
| 4,731,639 | 3/1988 | Gutmann et al. | 347/32 |
| 4,736,213 | 4/1988 | Piatt et al. . | |
| 4,740,796 | 4/1988 | Endo et al. | 347/56 |
| 4,873,549 | 10/1989 | Tada et al. | 355/206 |
| 4,875,055 | 10/1989 | McCann et al. | 346/75 |
| 4,962,430 | 10/1990 | Hiroki et al. | 358/296 |
| 4,965,640 | 10/1990 | Watari et al. | 399/122 |
| 4,974,033 | 11/1990 | Yamada et al. | 355/319 |
| 5,041,846 | 8/1991 | Vincent et al. | 347/102 X |
| 5,150,166 | 9/1992 | Matsuura et al. | 399/110 |
| 5,184,178 | 2/1993 | Takayanagi et al. | 347/138 |
| 5,355,160 | 10/1994 | Ozawa et al. | 347/108 |

INK JET APPARATUS HAVING A RECORDING UNIT CARTRIDGE INCLUDING A RECORDING HEAD, INK SUPPLY SYSTEM AND INK COLLECTING MEMBER

This application is a continuation of application Ser. No. 08/281,662 filed Jul. 28, 1994, which in turn is a continuation of application Ser. No. 07/973,549 filed Nov. 9, 1992, which is a continuation of application Ser. No. 07/633,956 filed Dec. 26, 1990, all now abandoned.

FIELD OF THE INVENTION AND RELATED ART

The present invention relates to an ink jet recording apparatus and a recording unit cartridge wherein a desired image is formed by ejection of ink.

As shown in FIG. 1, an ink jet apparatus comprises a recording head 101 having an ejection outlet for ejecting ink, an ink container 101 for containing ink ejected from the head 101, a pipe 103 (ink supply pipe) for supplying the ink from the container 102 to the head 101, a pump 104 for the ink supply or for filling the head with the ink at the initial stage, an ink receptor 105 for receiving the ink not used for the recording or a cap member 105 for contacting the ejection side surface of the head 101 to protect it or to recover the ejection of the ink from the head, a pump 107 for collecting the ink not used, a residual ink container 106 and a controller for controlling them. When the ink container 102 becomes empty by consumption of the ink for the recording, the ink container 102 is replaced with a fresh container, so that the recording operation can be continued. If, however, when the recording head 101 is damaged or worn to be not usable for the good recording operation, the recording head 101 is removed from the pipe 103, and is replaced with a fresh recording head, by which the recording operation can be continued. If the quantity of the ink in the residual ink container increases beyond its capacity, the residual ink container 106 is replaced with an empty one, by which the contamination of the apparatus attributable to the overflow of the residual ink can be prevented. In the apparatus, the replacements have been possible for the respective constituent parts to maintain the quality of the recorded images.

The apparatus in which the parts are replaceable, is advantageous in that the good operation of the system can be maintained simply by replacing only the part that needs to be replaced. However, such an apparatus involves the following problems.

(1) Since the number of the parts is large, large spaces and expertise is required and the cost of the entire apparatus is high.

(2) Since it has many connections between constituent parts, the ink may leak from the connecting portion or portions due to vibration or inclination during the apparatus being carried. If this occurs, the inside of the apparatus may be contaminated. The high positioning accuracy is required among the constituent parts such as the recording head, a platen roller, the capping member, a cleaning member for cleaning the ejection side surface of the head, the ink container and the residual ink container. The high accuracy is required because the ink is used for the recording. In order to take great care to prevent introduction of foreign matter such as dust during the replacing operation, and therefore, the maintenance operation is time consuming.

It will be understood that these problems are particularly noted when a simple and low cost apparatus is considered.

SUMMARY OF THE INVENTION

Accordingly, it is a principal object of the present invention to provide an ink jet apparatus in which the recording head, the ink container, the residual ink container or the like (consumable part) are easily replaceable without the liability of introduction of foreign matter or without the necessity for the high accuracy positioning, by which the stabilized and ensured recording operations are maintained with a simple structure and at a low cost.

It is another object of the present invention to provide an ink jet recording apparatus wherein the recovery and protection of the recording head can be assured without the liability of the introduction of foreign matter, by which the recording operation is maintained.

According to an aspect of the present invention, there is provided a recording unit cartridge, comprising as a unit: a recording head for ejecting ink to effect recording; an ink supply system for supplying the ink to said recording head; a capping member for covering an ink ejection side surface of said recording head; an ink collecting member for the ink discharged to recover said recording head and not used for the recording; a cleaning member for cleaning the ink ejection side surface of said recording head; and a casing for containing as a unit said head system and members, wherein said unit cartridge is detachably mountable to a main assembly of a recording apparatus.

According to another aspect of the present invention, there is provided an ink jet apparatus, comprising: a recording unit cartridge, comprising as a unit: a recording head for ejecting ink to effect recording; an ink supply system for supplying the ink to said recording head; a capping member for covering an ink ejection side surface of said recording head; an ink collecting member for the ink discharged to recover said recording head and not used for the recording; a cleaning member for cleaning the ink ejection side surface of said recording head; a casing for containing as a unit said head system and members, wherein said unit cartridge is detachably mountable to a main assembly of a recording apparatus; and a mount for detachably mounting said cartridge and having a driving system for moving the recording head in said cartridge when the cartridge is mounted on said mount.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 2:
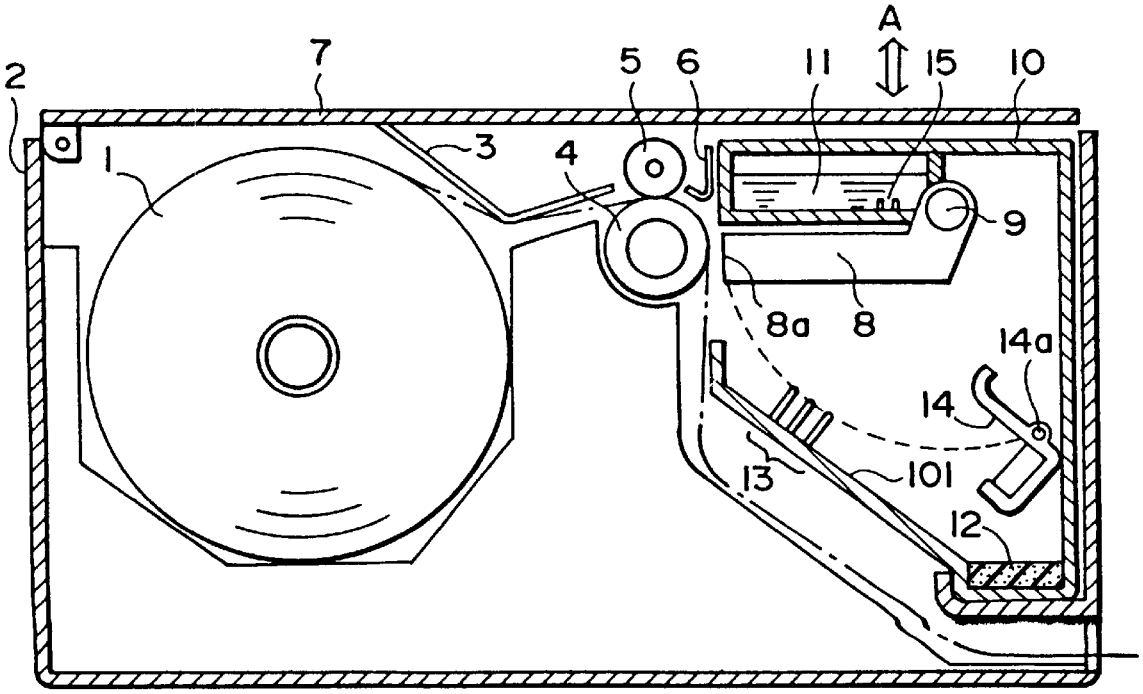
FIG. 2 is a sectional view of an ink jet recording apparatus according to an embodiment of the present invention.
Figure 3:
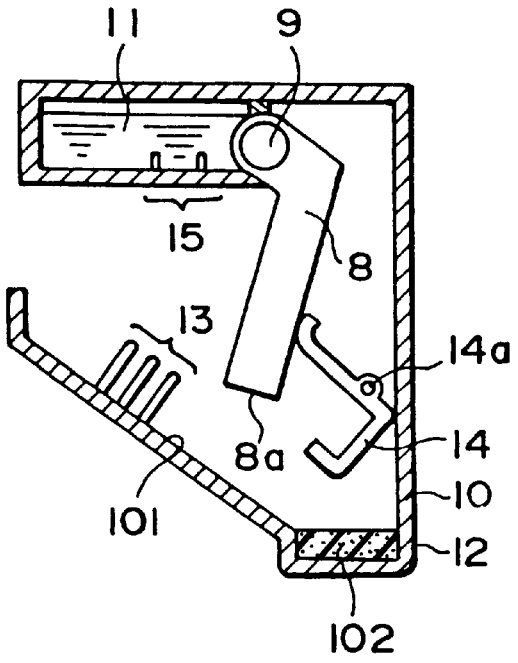
FIGS. 3 and 4 are sectional views illustrating rotational motion of the recording head according to the embodiment of the present invention.
Figure 4:
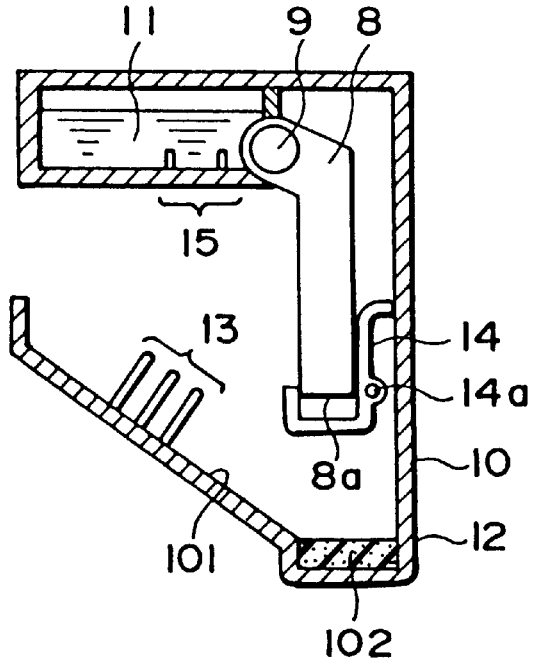

Referring to FIG. 2, there is shown an ink jet recording apparatus according to a first embodiment of the present invention. In this Figure which is a sectional view, a reference numeral 1 designates a rolled recording paper which is accommodated in a casing 2 of a main assembly of the recording apparatus. The recording apparatus comprises a recording paper guide 3 for confining the recording paper, a conveying roller 4 driven by an unshown driving means, a roller 5 mounted on a cover 7 of the main assembly together with a contact guide 6 of the recording paper guide 3. Upon operation under the state shown in the Figure, the roller 5 is urged to the conveying roller 4 through the recording paper, by which the recording paper can be fed. The recording paper guide 3 is close to or contacted to the conveying roller 4, so that the recording paper passage position is limited. A full-line ink jet recording head 8 is provided with ejection outlets for ejecting ink over the entire length (recording width), and each of the ejection outlets is provided with an electrothermal transducer or energy generating element for generating energy contributable to the ejection of the ink. The recording head 8 is rotatably supported on a rotational shaft 9. In this Figure, the recording head 8 is shown as being positioned at its printing position. By ejection of ink droplets through the ejection outlets 8*a* to the recording paper, a desired image is recorded on the recording paper. The position of the line recording effected is selected to be slightly below an end of the contact guide 6 so that the recording paper is stably passed, by which the printing quality is assured. A cartridge detachably mountable to the main assembly is comprised of a casing 10, the recording head 8, the ink supply container 11, a residual ink receptor 12 having an ink absorbing material such as sponge, a wiping blade 13 for cleaning the ejection side surface of the head and a cap 14 for contacting and capping an ejection side surface of the recording head during non-recording period and during the recording head recovery operation or the like. The casing covers these element as a unit. The blade 13 is made of elastic material such as silicone rubber, and it is hydrophilic to efficiently wipe the ejection side surface. When the recording head 8 rotates about the shaft 9 between its recording position and non-recording position, the ejection side surface of the head is in contact with the blade 13 so as to be wiped. In this Figure, three blades 13 are provided. However, one blade may be enough, or more blades may be used. The number thereof is not limited if the ink can be satisfactorily wiped out from the ejection side surface. A cap 14 functions to seal the ink ejection outlets so as not to permit the recording head to be dried during the rest period of the apparatus. As shown in FIGS. 2 and 3, the cap 14 rotates about the center 14*a* in contact with a part of the recording head 8 and using the rotational motion of the recording head 8, by which it seals the ejection side surface of the recording head, as shown in FIG. 3 (capped state).

When the cover 7 of the main assembly is opened from the main assembly 2, the cartridge 10 is detachable or mountable relative to the main assembly 2. In this embodiment, therefore, the recording head 8, the ink container 11, the residual ink receptor 12, the wiping blade 13, the cap 14 and the like are replaced as a unit.

From the standpoint of simplifying the structure, the cartridge 10 does not have a driving source for the rotational movement of the head 8 in the cartridge. Therefore, the head driving source is disposed in the main apparatus and is operatively coupled with the cartridge 10 to transmit the driving force to the cartridge 10.

Figure 5:
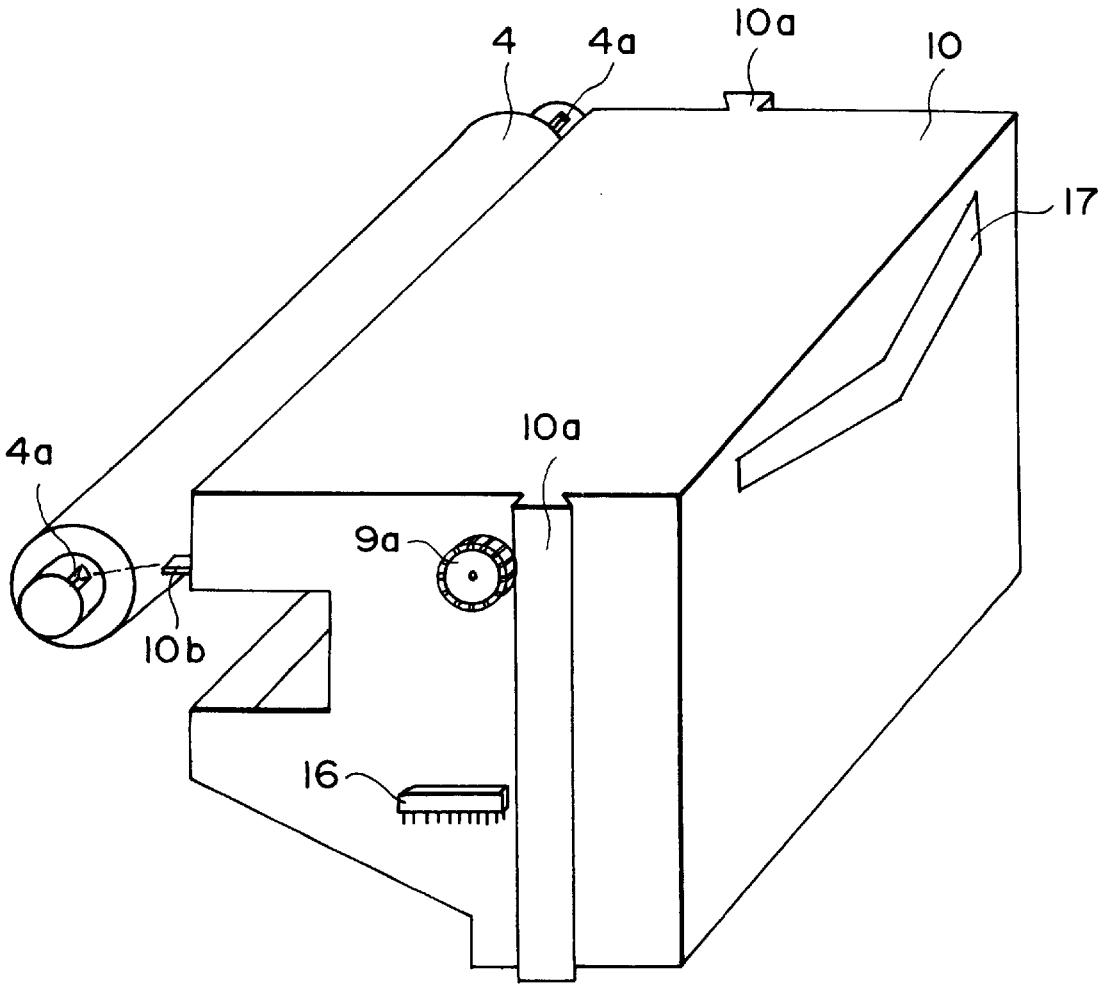
FIG. 5 shows a positioning member used when the cartridge is mounted into the main assembly of the recording apparatus.

More particularly, as shown in FIG. 5, the positioning is effected by aligning a guide 10*a* of the cartridge 10 and the corresponding guide (not shown) of the main assembly of the apparatus, by which the cartridge is correctly positioned relative to the main assembly. With this aligned state maintained, the cartridge is slid into the main assembly. By doing so, the cartridge falls to be set correctly, upon which the unshown driving gear of the cartridge and the drive transmission gear 9*a* are meshed to establish a driving connection therebetween. The gear meshing is utilized in this embodiment as a part of positioning members, by which the positioning accuracy upon the mounting of the cartridge is improved. In addition, the electric connection for the purpose of transmission of the image signals from the main assembly of the apparatus, is also established.

The positioning between the main assembly and the cartridge 10 is accomplished by a guide 10*a*. Another structure is usable if the correct positioning is accomplished. In order to improve the accuracy of the clearance between the head 8 and the platen (conveying) roller 4, that is, the head-paper clearance, positioning members 4*a* may be provided at the opposite ends of the conveying roller 4 of the main assembly to be contacted to the corresponding positioning members (limiting members) 10*b* of the cartridge. At this time, a leaf spring or the like 17 may be used at a backside of the cartridge to urge the cartridge toward the positioning member 4*a* for the conveying roller, by which the accuracy is further improved.

In this embodiment, the cartridge 10 has a sensor for detecting a remaining amount of the ink 11, as indicated by a reference numeral 15 in FIG. 2. It is of such a pipe that an electric resistance between electrodes is detected. Therefore, the timing of the cartridge 10 replacement is detected by the use-up of the ink. Various parts of the cartridge 10 are designed in consideration of the operable driving period of the recording head, the capacity of the residual ink receptor 12, durability of the cap 14 and the durability of the wiping blade or the like matched with the use-up of the ink contained.

The description will be further made as to the cartridge.

Figure 1:
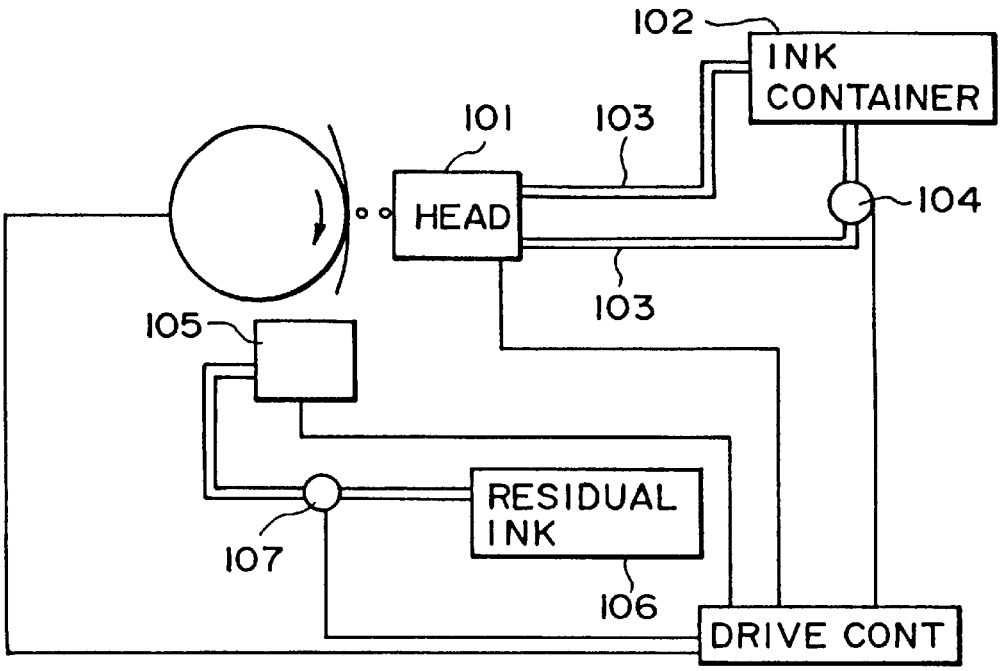
FIG. 1 shows a conventional ink jet apparatus.

The recording head is positioned at the position shown in FIG. 1 by an unshown recording head driving motor, and while the recording head 8 is stationary at this position, the recording operation is effected. At this time, the ink is supplied from the ink container disposed above the recording head 8. The position of the ink container is not limited to this, but may be different if the ink can be satisfactorily supplied to the recording head. It is possible to dispose it below the recording head.

In order to stabilize the ink supply at this time, the supporting member for the recording head is bent, so that the position of the ejection outlets and the rotational shaft are deviated, as shown in FIG. 1. Then, the ink passages having the electrothermal transducers in the recording head and the surface of the ink in the ink container 11 are maintained substantially parallel. Upon interruption or stop of the recording operation, the rotation of the motor is transmitted to the recording head so that the recording head 8 rotates downwardly from the recording position to the non-recording position. The blade 13 is fixed in the cartridge at such a position that it wipes the plural ejection outlets during the rotational movement, by which all of the ejection outlets are cleaned by rotation of the recording head through 10–80 degrees. After the cleaning, the recording head 8 continues to rotate to reach a capping position where the cap 14 is disposed (FIG. 3 position, that is, capping position). At this timer the ink removed from the recording head by the above-described wiping action flows along the blade 13 and an inclined surface 101 on which the blades are mounted, into a residual ink container 12 disposed below the cap 14.

The residual ink container 12 contains an ink absorbing material made of porous material to retain the residual ink.

The cap 14 rotates about its supporting shaft by the rotational movement of the recording head and caps the ejection side of the recording head 8 when the ejection side surface faces down.

As described in the foregoing, according to this embodiment, the recording head 8, the ink container 11, the cap 14, the residual ink container 12 and the blade 13 are contained as a unit in the cartridge. Therefore, it can be replaced without difficulty and without liability of the introduction of the foreign matter. Thus, the expertise is not required for the maintenance. Thus, the ordinary use can effect the maintenance operation without difficulty. In addition, since the recording head is moved away from the recording surface (recording position) by the rotational motion, and is returned to the recording position by the reverse rotation from the capping position, the driving system for the recording head is simplified, and the cost of the cartridge can be reduced.

Embodiment 2

The fundamental structure and the sequential operations of the apparatus of this embodiment are the same as the first embodiment, but it is different from the first embodiment in that the recording head is disposed in the main assembly, and the ink container, the blade, the cap and the residual ink receptor are in the cartridge detachably mountable to the main assembly. By doing so, the cost of the cartridge is further reduced. In addition, the mechanism for the correct positioning of the recording head can be omitted, by which the easiness of the replacement operation is enhanced.

In the present invention, the specific structure of the main assembly (rolled paper, driving roller or the like), the positioning of the parts in the cartridge and the like are not limiting.

According to the embodiments described in the foregoing, the following advantageous effects are provided.

(1) The constituent elements of the ink supply system of an ink jet recording apparatus are all contained in a cartridge as a unit, and therefore, the liability of introduction of foreign matter into the ink supply system is eliminated; the liability of the ink leakage is reduced; the leaked ink, if any, is confined within the cartridge without liability of influence to the main apparatus. The ink supply system can be arranged in a small space.

(2) During cleaning and repairing operation for the leaked ink due to a trouble in the supply system, the liability of an additional trouble by the ink can be eliminated, thus achieving an easy maintenance because of the replacement of the cartridge as a whole.

(3) By matching the service life of substantially all of the functional elements with the amount of the ink contained, the parts around the ink can be reasonably designed to reduce the manufacturing cost.

(4) The manufacturing plant may be divided into a part manufacturing the main assembly and a part manufacturing the cartridge, by which the manufacturing lines may be classified depending on the presence or absence of the ink, so that the manufacturing cost can be reasonably reduced, and the productivity can be improved, and in addition, the inspection steps can be simplified.

Embodiment 3

Figure 6A:
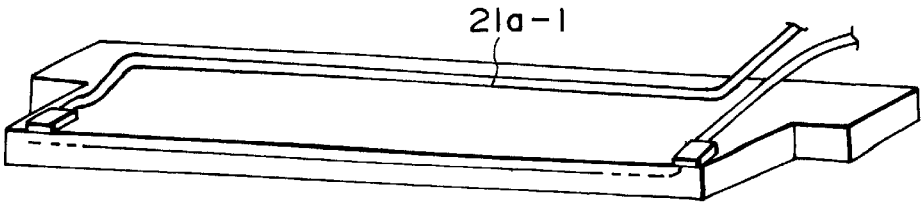
FIGS. 6A and 6B illustrate an ink jet recording head and an ink supply system.
Figure 6B:
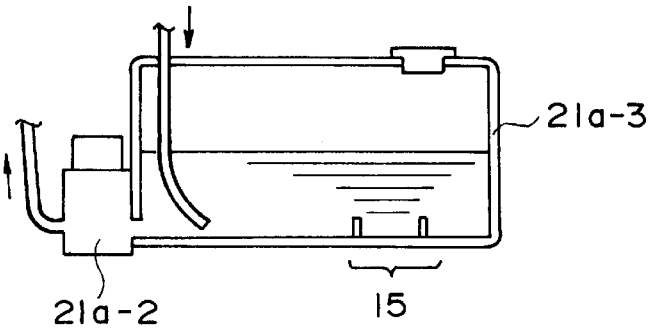

Referring to FIGS. 6A and 6B, there is shown an example of a line recording ink jet head. As will be understood, a large number of ink ejection outlets are distributed over the entire recording width. The ink is supplied through the ink supply passage 21*a*-1. Ink ejecting means (heater or the like not shown) is provided for each of the ejection outlets and is controlled to effect the line recording, thus increasing the printing speed and the printing quality.

Peculiar to the ink jet recording, there is a liability of improper printing attributable to evaporation, drying, leakage or the like of the ink, contamination thereby, contamination by foreign matter, production of bubble in the ink supply passage or the like. In order to prevent the occurrence of improper printing, a head recovery operation is desired in the printing intervals or in the rest period by idle ejections through all of the ejection outlets of the head or by filling the head with the ink or the like. Also, it is desired that the ejection outlets of the head are sealed by a capping mechanism. These are effective to eliminate the liability of improper recording particularly after a long rest period.

Figure 7:
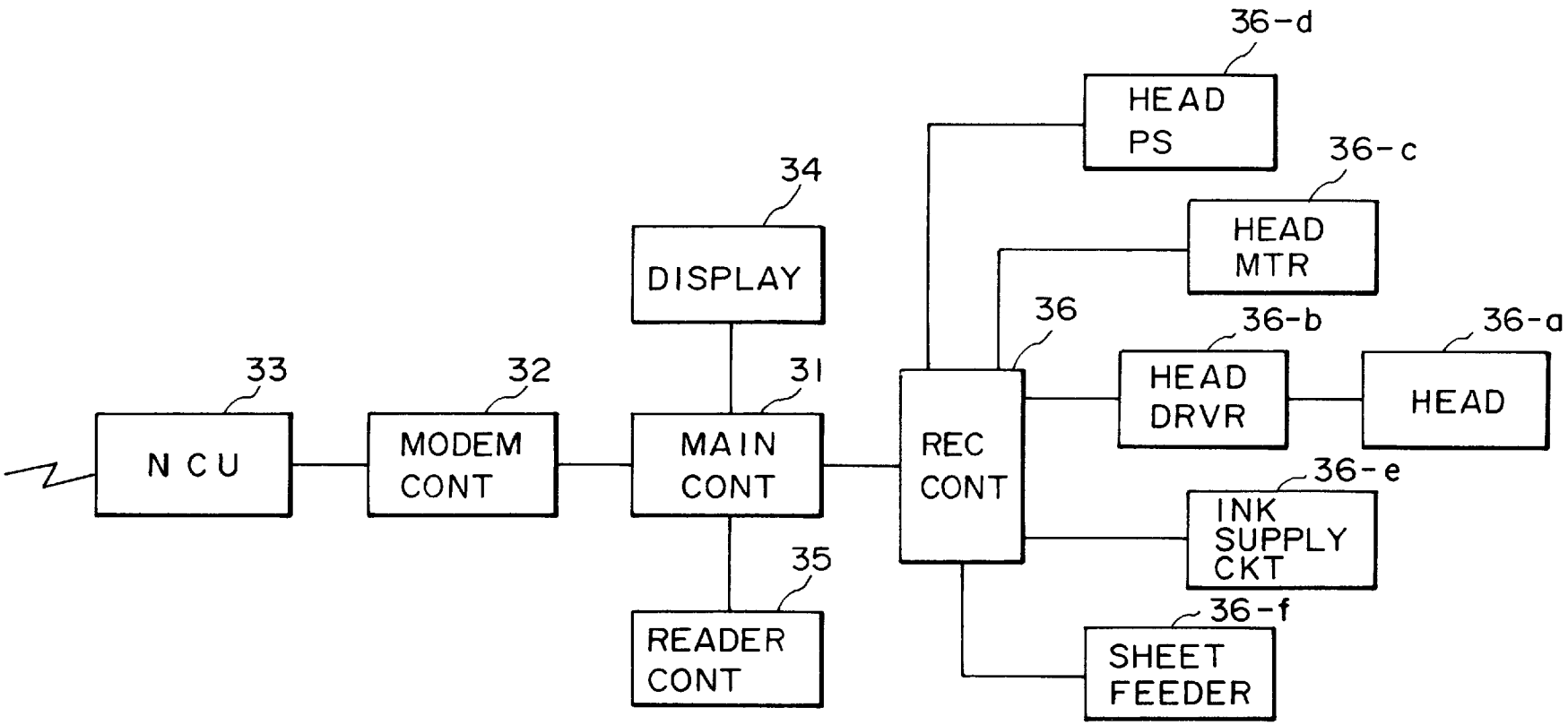
FIG. 7 is a block diagram of a facsimile machine according to an embodiment of the present invention.

FIG. 7 is a block diagram of a facsimile machine according to an embodiment of the present invention. It comprises a main controller 31 to control the facsimile operations such as reading, recording, communication or the like, a modem controller 32 connected with a telephone line through NCU 33, an operation and display panel 34 including LCD and LED key switches, and a reader controller including CCD or contact sensor. A controller 36 effects a control operation for recording the image read by the reader 35 or the image received by the modem controller 32. The printing operation is started by actuating a driving circuit 36-*b* for the data transferred to the head 36-*a*. A motor 36-*c* moves the head to a rest position, a recovery position, a printing position or the like. A position detecting sensor 36-*d* detects the position of the head. A circuit 36-*e* is provided to effect the ink supply to the line head. The ink supply operation is carried out after replacement of the ink cartridge or upon the recovery operation for the head. A motor 36-*f* is a line feed motor for feeding the recording paper line by line.

Figure 8:
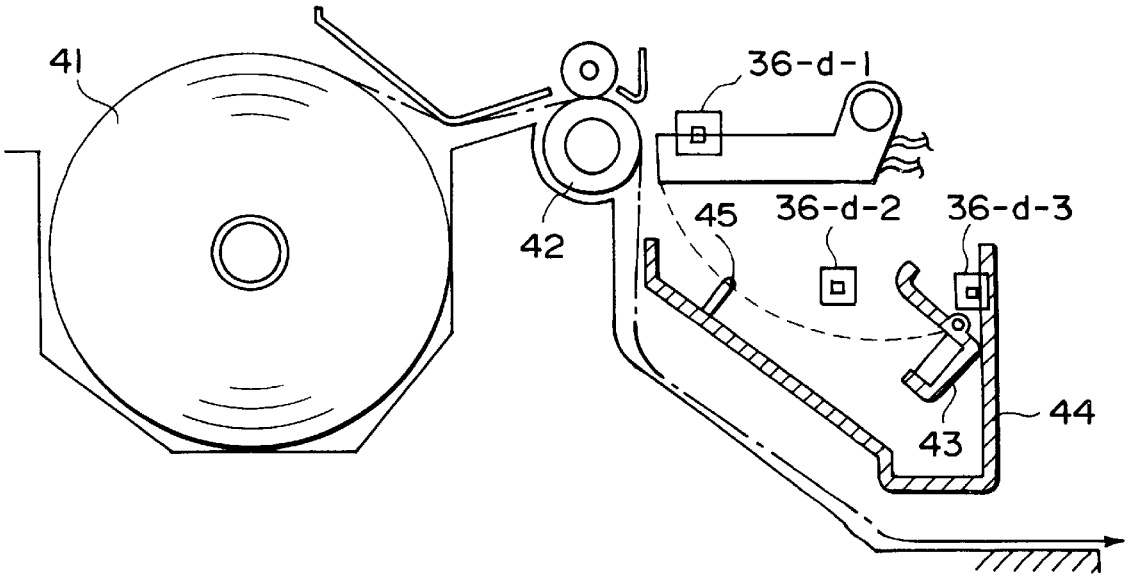
FIG. 8 is a sectional view of an ink jet recording means in a facsimile machine.

FIG. 8 is a sectional view of an ink jet recording device according to the embodiment of the present invention. Recording paper is designated by a reference numeral 41. It comprises a recording paper feeding platen roller 42, an ink jet head maintaining cap 43 and a residual ink tray 44. It further comprises a printing position sensor 36*d*-1, a recovery position sensor 36*d*-2 and a rest position sensor 36*d*-3, and a blade 45. The ink jet head of FIG. 6A is a full-line type ink jet head wherein the number of ejection outlets covers the entire length of one recording line. The ink supply pipe 36*a*-1 is used to supply the ink from the ink container by a gear pump.

The description will be made as to the operation at the stop position of the recording head. When the sensor 36*d*-1 in FIG. 8 is actuated, the recording head is at the printing position, in which the head driving circuit 36-*b* is actuated to effect the recording. When the sensor 36*d*-2 is actuated, the head is at the head recovery position in which in order for the recovery from the improper printing attributable to the clogging of the nozzle or the ink evaporation, the ink supply operation (36-*e*) or the idle ejection (36-*b*) (solid black image) are effected. The ink ejected is received by the residual ink tray. When the sensor 36*d*-3 is actuated, the head is at the rest position in which the head is capped for the purpose of prevention of the ink evaporation and the prevention of the clogging during the non-use of the head.

Designated by a reference 36*a*-2 is a gear pump for supplying the ink to the head from the ink cartridge 36*a*-3. By actuating the ink filling circuit 36-*e* in FIG. 5, the pump is driven to supply the ink. The recovery operation includes a method in which the ink is supplied by the pump and a method in which all black information is supplied to the recording head, and the head driver circuit 36-*b'* of FIG. 7 is actuated to effect the solid black printing while the recording head is at the recovery position. In addition, during the head movement, the ejection side surface of the recording head is wiped by the blade 45, so that the residual ink adjacent the ejection outlets are removed.

Figure 9:
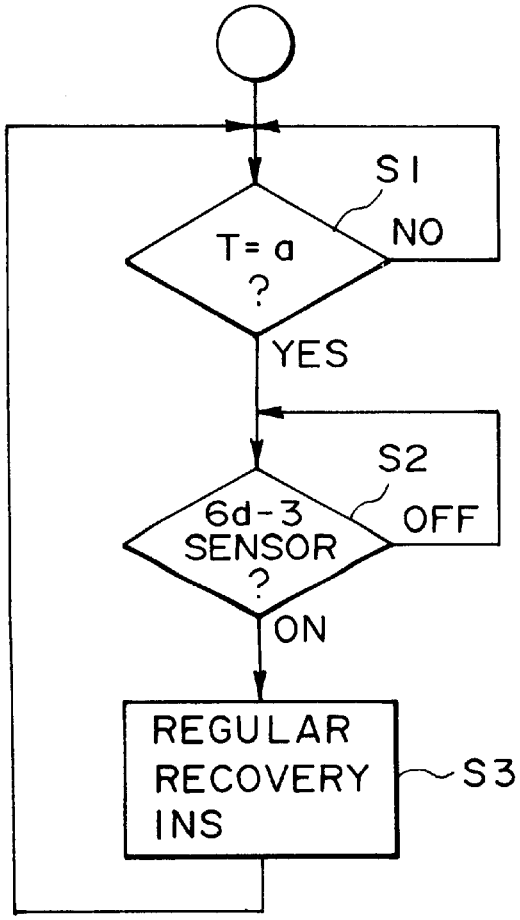
FIG. 9 is a flow chart illustrating the control operation of a main controller used in an embodiment of the present invention.
Figure 10:
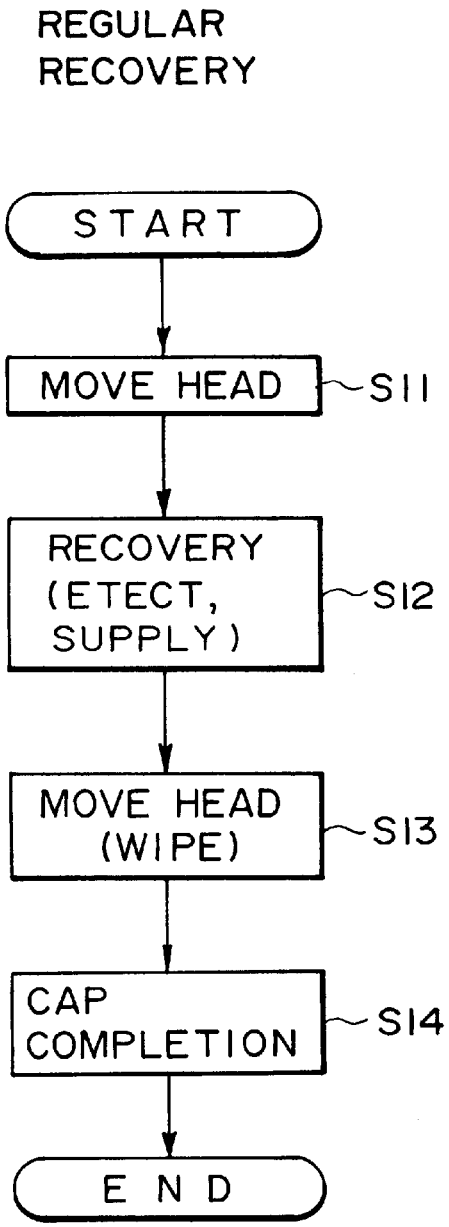
FIG. 10 is a flow chart illustrating the control operation of a record controller according to an embodiment of the present invention.

Referring to FIGS. 9 and 10, the operation will be described; FIG. 9 is a flow chart of the operation of the main controller; and FIG. 10 is a flow chart of the operation of the record controller.

FIG. 9 is the flow chart of the operation of the main controller during the regular recovery operations. At step S1, the discrimination is made as to whether the time T in the display circuit is equal to the predetermined time a. The time is expressed by CD minutes past AB o'clock (24 hours expression). Assuming that the recovery operation is carried out every 10 minutes, then D is selected for the time a (D=0). If the recovery operation is carried out every 30 minutes, then CD is selected for the time a (C=0 or 3, and D=0). When T=a is satisfied, a step S2 is executed. When the capping position of the recording head is discriminated by the on-off detection by the sensor 36*d*-3, a step S3 is executed to produce instructions for the regular recovery operation to the record controller, and the flow of the sequence returns to the step S1.

FIG. 10 shows the flow chart of the operation of the record controller upon receiving the regular recovery instructions. At step S11, the head moving motor 36*c* is driven until the sensor 36*d*-3 is actuated, that is, until the head reaches the recovery position. At step S12, the recovery operation described hereinbefore is carried out. At step S13, the head moving motor 36*c* is driven to move the recording head from the recovery position, to move in contact with the blade 45, and to return. Subsequently, at step S14, the head is moved to the rest position where it is capped, and the sensor 36*d*-3 is actuated. This is the end of the regular recovery operation.

In place of the wiping blade, a water absorbing sponge material or roller is usable. The capping means may be equipped with a driving means therefor. The cleaning position, the recovery position, the rest position and the printing position may be changed in their relative positional relation. The record controller may contain the time counting function to effect its control. Other various modifications are possible within the scope of the present invention.

Embodiment 4

In this embodiment, the facsimile machine is usable with a cut sheet. The recording head, the cap, the blade, the ink supply container and the residual ink container are contained as a unit in a cartridge. The cartridge is detachably mountable into the recording apparatus.

Figure 11:
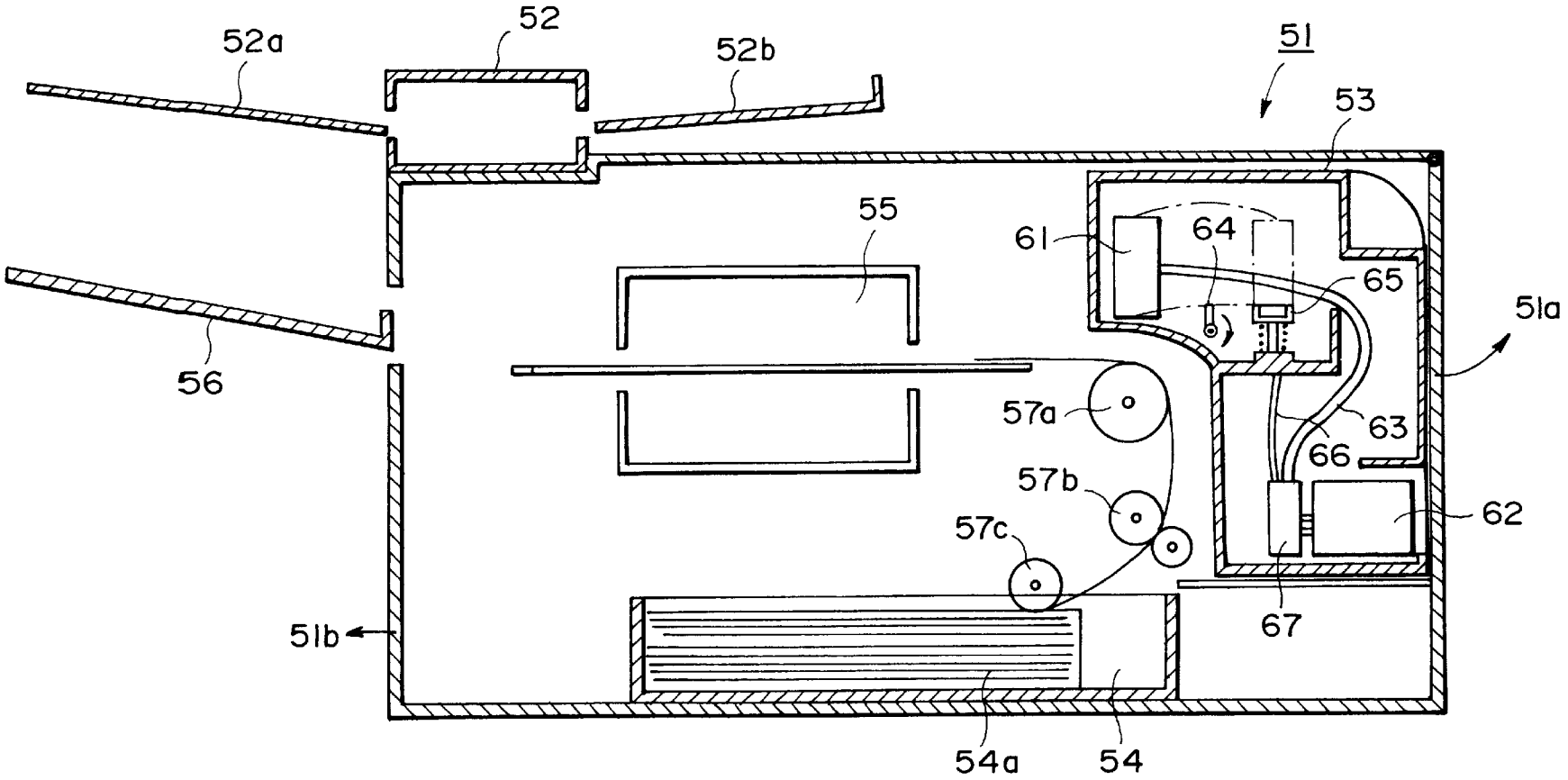
FIG. 11 is a sectional view of an ink jet apparatus according to a further embodiment of the present invention.

FIG. 11 shows a general arrangement of the facsimile machine 51. It comprises an image reader 52, a recording material container 54, a cartridge 53, an image fixing station 55, a recording sheet discharging station 56, a recording sheet conveying portion 57 and the like.

The image reader 52 is provided with an original feeding system (not shown) which feeds an original from an original tray 52*a* to an original discharge tray 52*b*, and during the feeding, a sensor of the reader 52 reads the original, and the read information is transmitted.

The image received thereby is recorded on a recording sheet 54*a* conveyed from the recording sheet supply tray 54 to the recording station by a feeding roller 57. The image thus recorded is fixed in the fixing station 55, and the sheet is discharged to the discharge tray 56.

The recording sheet supply tray 54 is exchangeable when a cover 51*b* provided in a side of the apparatus 51 is opened in a direction indicated by an arrow.

A cartridge 53 which is detachably mountable into the recording apparatus comprises as a unit an ink cartridge 62 connected to a recording head 61, a cap 65, an ink supply container and a discharge ink container, an ink supply tube 63 for supplying the ink to the head 61, a residual ink tube 66 connected with the cap 65, and a blade 64 for cleaning the ejection side surface of the head 61. The cartridge 53 is mounted to or dismounted from the main assembly of the apparatus 51 when the cover 51*a* formed in a part of a side wall of the apparatus 51 is opened. As for the positioning mechanism upon the mounting or dismounting operation, the structure of the first embodiment is usable.

Figure 12:
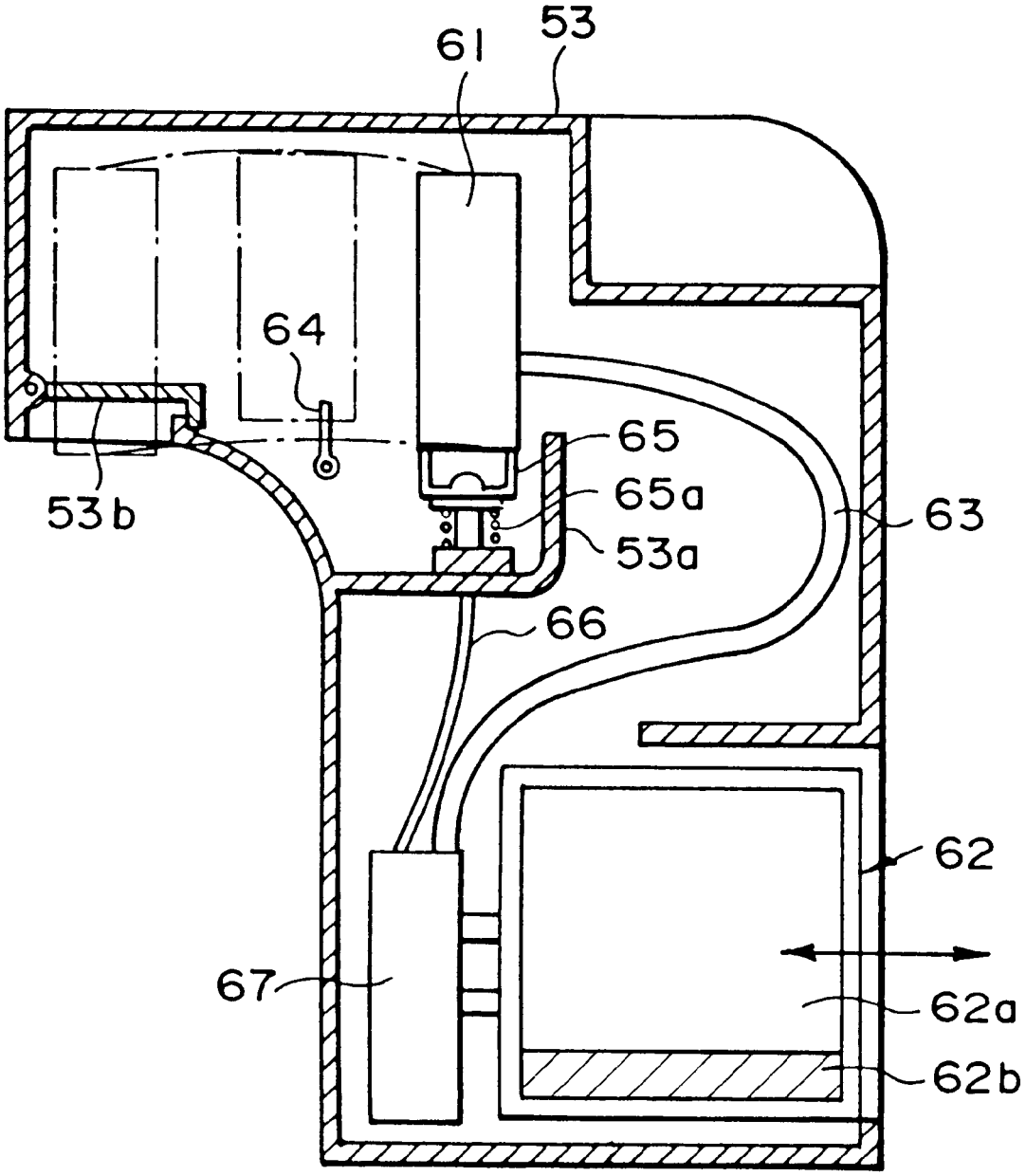
FIG. 12 is a sectional view of another example of a recording unit cartridge used with the apparatus of FIG. 11, according to an embodiment of the present invention.

As shown in FIG. 12, the cartridge 53 of this embodiment is also equipped with a driving system (not shown). By the driving system, the recording head 61 is movable between a recording position indicated by a broken line and a non-recording position faced to the cap 65, indicated by the solid line. The cartridge is provided with a shutter 53*b* at the recording position of the head 61, the shutter 53*b* being opened while it is mounted in the apparatus.

In the movement path of the recording head, there is a blade 64 for cleaning the ejection side surface of the head. The blade 64 accomplishes the cleaning by the rotation thereof while the recording head is retained at the cleaning position. The rotational direction may be either rotational direction but if it is the clockwise direction in the Figure, the recording region is prevented from contamination by ink mist upon the cleaning operation. If it is counterclockwise, a blocking wall may be used for the protection from the ink mist. An ink absorbing material contactable to the cleaning surface of the blade may be disposed in the rotational path of the blade 64. The cap 65 at the non-recording position is mounted to a rib 53*a* projected from the cartridge casing to cover the ejection side surface of the recording head. The cap is urged toward the head by a spring member 65*a* to buffer the impact of contact upon covering the head and to ensure the capping.

In the cartridge 53, there is an ink cartridge 62. The ink cartridge 62 comprises an ink container 62*a* containing the ink to be supplied to the head 61 through the ink supply tube 63 and a residual ink container 62*b* for accommodating the ink discharged from the head 61 into the cap 65 by idle ejection, through an ink collecting tube 66, as a unit.

The ink cartridge 60 is detachably mountable to the cartridge 53. It is joined with the ink supply tube 63 and the ink collecting tube 66 by a joint 67 to establish the ink supply to the head 61 and the ink collection from the cap 65.

In this embodiment, consideration is made to the case in which the quantity of the ink in the ink container is relatively small as compared with the service life of the recording head, and therefore, even if the ink in the container is used up, the recording head is still usable. Accordingly, only the ink container 62 is replaceable upon use-up of the ink.

If the maintenance or service operation is required with respect to a part other than the ink container 62, the cartridge 53 is removed from the main assembly of the recording apparatus, and another cartridge is mounted thereinto. In this manner, the maintenance is easy. It is the fact that the connection of the ink passage, for example, the fitting between the head and the ink supply tube or the fitting between the cap and the ink collection tube, is difficult, and in addition, it is possible that the apparatus is contaminated with the ink, or the operator's hand is contaminated thereby during the maintenance operation. Therefore, the cartridge structure of this embodiment is desirable.

According to this embodiment, the element such as the recording head having a relatively long service life and an element having a relatively shorter service life, can be separately replaceable, by which the long life element is effectively used.

The cartridge 53 contains all the systems containing the ink and is separated from the other units by the cartridge casing. Therefore, it does not easily accept the foreign matter such as paper dust produced from the recording paper or the dust in the apparatus, so that the ejection side surface of the recording head, the capping member and the blade are effectively protected; even if the ink is leaked, the leaked ink does not influence the other unit or units; and upon malfunction of the ink supply system, the maintenance is easy since it includes only the replacement of the cartridge, the maintenance operation otherwise having been difficult.

In addition, the unit may contain an original reader system and a recording system for recording an image received thereby. The unit is easily replaced, as desired. The easy maintenance is similarly accomplished by constructing as a unit the image reading system and constructing as a unit the recording system. The unit structure is not limited to these two examples. For example, a sheet feeding system in the recording system and the ink (image) fixing system may be constituted as the respective units or as a single unit to further facilitate the maintenance operation. When the recording paper feeding system is a replaceable unit, a plurality of feeding system units may be of different types, for example, one for cut sheets and another for rolled paper. When the fixing system is constituted as a unit, the fixing system may correspond to the recording material used. The recording unit cartridge may be of the full-line type or a serial type or a multi-color recording head type (the driving system for the head is desirably provided in the cartridge for the purpose of simplified structure).

The present invention is particularly suitably usable in a bubble jet recording head and recording apparatus developed by Canon Kabushiki Kaisha, Japan. This is because, the high density of the picture element, and the high resolution of the recording are possible.

The typical structure and the operational principle are preferably those disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or a plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressurizing or suction means, preliminary heating means by the ejection electrothermal transducer or by a combination of the ejection electrothermal transducer and an additional heating element and means for preliminary ejection not for the recording operation, which can stabilize the recording operation.

As regards the kinds of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in a usual recording apparatus of this type, the ink is such that it is liquid within the temperature range when the recording signal is applied. In addition, the temperature rise due to the thermal energy is positively prevented by consuming it for the state change of the ink from the solid state to the liquid state, and the ink material being solidified when it is unused may prevent the evaporation of the ink. In either of the cases upon the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective system for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A modular ink jet recording apparatus comprising:

a recording unit module, selected from a plurality of recording unit modules which include different types of recording heads for effecting recording by ejecting ink onto a recording material, and which include different types of ink containers for containing ink to be supplied to said recording heads, said recording unit module including a unit casing, a full-line head having an array of ejection outlets covering a recording width of said ink jet recording apparatus, in an ejection side surface thereof, an ink supply passage for supplying ink to said full-line head, the ink container for containing the ink to be supplied through said ink supply passage, a recovery mechanism, including a cap, for recovering said full-line head by ejecting liquid through the ejection outlets, a collecting passage for collecting ink discharged through the ejection outlets by said recovery mechanism, a collecting portion for collecting the ink through said collecting passage; a moving mechanism for moving, along a moving path, said full-line head between a recording position for effecting recording and a recovery position where said recovery mechanism acts on said recording head, and a cleaning member, provided in the moving path, for cleaning said ejection side surface, wherein all of said full-line head, said ink supply passage, said ink container, said recovery mechanism, said collecting passage, said collecting portion, said moving mechanism and said cleaning member are contained in said unit casing;

a recording material feeding unit module, coupled with said recording unit module and selected from a plurality of recording material feeding unit modules which include platens on which the recording material is supported and feeding rollers for feeding the recording material; and a fixing unit module, coupled with said recording unit module and selected from a plurality of different types of fixing unit modules which include fixing heaters, wherein said recording unit module, said recording material feeding unit module and said fixing unit module, respectively selected from different types of modules, constitute said recording apparatus.

2. An apparatus according to claim 1, wherein said plurality of recording unit modules include unit modules having a monochromatic recording head and a full color recording head.

3. An apparatus according to claim 1, wherein each recording head ejects the ink using thermal energy producing film boiling in the ink.

4. An apparatus according to claim 1, further comprising a driving system for moving said recording head.

5. An apparatus according to claim 1, wherein said apparatus comprises a facsimile apparatus including means for reading an image of an original, means for transmitting read information and means for receiving information from an external source and means for recording the received information on the recording medium.

6. An apparatus according to claim 5, wherein said image reading means comprises a replaceable unit.

7. A recording unit module detachably mountable relative to an ink jet recording apparatus, comprising:

a unit casing;

a full-line head having an array of ejection outlets covering a recording width of said ink jet recording apparatus, in an ejection side surface thereof;

an ink supply passage for supplying ink to said full-line head;

an ink container for containing the ink to be supplied through said ink supply passage;

a recovery mechanism, including a cap, for recovering said full-line head by ejecting liquid through the ejection outlets;

a collecting passage for collecting ink discharged through the ejection outlets by said recovery mechanism;

a collecting portion for collecting the ink through said collecting passage;

a moving mechanism for moving, along a moving path, said full-line head between a recording position for effecting recording an a recovery position where said recovery mechanism acts on said recording head; and a cleaning member, provided in the moving path, for cleaning said ejection side surface, wherein all of said full-line head, said ink supply passage, said ink container, said recovery mechanism, said collecting passage, said collecting portion, said moving mechanism and said cleaning member are contained in said unit casing.

8. A recording unit module according to claim 7, wherein said ink container and said collecting portion are integral with each other, and are integrally demountable from said recording unit module.

* * * * *

UNITED STATES PATENT AND TRADEMARK OFFICE

CERTIFICATE OF CORRECTION

PATENT NO. : 5,988,787

DATED : November 23, 1999

INVENTOR(S) : WATANABE ET AL.

It is certified that error appears in the above-identified patent and that said Letters Patent is hereby corrected as shown below:

IN THE DRAWINGS:

Sheet 6, Figure 10, Step S12, "(ETECT," should read --(EJECT,--.

COLUMN 1:

Line 63, "and" should be deleted.

COLUMN 3:

Line 54, "element" should read --elements--.

COLUMN 5:

Line 15, "timer" should read --time,--.

COLUMN 9:

Line 66, "system particularly" should read --system. Particularly,--.

COLUMN 10:

Line 5, "provide" should read --provided--.
Line 9, "the the" should read --the--.
Line 40, "or a" should read --or--.

UNITED STATES PATENT AND TRADEMARK OFFICE

CERTIFICATE OF CORRECTION

PATENT NO. : 5,988,787

DATED : November 23, 1999

INVENTOR(S) : WATANABE ET AL.

It is certified that error appears in the above-identified patent and that said Letters Patent is hereby corrected as shown below:

COLUMN 12:

Line 53, "an a" should read --and a--.

Signed and Sealed this

Sixteenth Day of January, 2001

*Attest:*

*Attesting Officer*

Q. TODD DICKINSON

*Commissioner of Patents and Trademarks*